US009850755B2

(12) United States Patent
Tiryaki et al.

(10) Patent No.: US 9,850,755 B2
(45) Date of Patent: Dec. 26, 2017

(54) BIT CONFIGURATION FOR A CUTTER HEAD

(71) Applicant: Joy MM Delaware, Inc., Wilmington, DE (US)

(72) Inventors: Bulent Tiryaki, Franklin, PA (US); David Bayne, Franklin, PA (US); David Meade, Franklin, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 152 days.

(21) Appl. No.: 14/796,500

(22) Filed: Jul. 10, 2015

(65) Prior Publication Data

US 2017/0009577 A1 Jan. 12, 2017

(51) Int. Cl.
*E21C 35/18* (2006.01)
*E21C 27/24* (2006.01)
*E21C 25/10* (2006.01)

(52) U.S. Cl.
CPC ..... *E21C 27/24* (2013.01); *E21C 25/10* (2013.01)

(58) Field of Classification Search
CPC ..... E21C 27/00; E21C 27/24
See application file for complete search history.

(56) References Cited

U.S. PATENT DOCUMENTS 3,307,880 A 3/1967 Newton et al.
3,325,219 A 6/1967 Guillon et al.
3,343,883 A * 9/1967 Whittaker ..... E21C 35/18 299/53
3,726,563 A 4/1973 Galis
4,012,077 A 3/1977 Roepke et al.
4,310,199 A 1/1982 Freed, Jr. et al.
4,371,210 A 2/1983 Leibee
4,382,633 A 5/1983 Ludlow et al.
(Continued)

FOREIGN PATENT DOCUMENTS

CN 102758623 A 10/2012
WO 2013126944 A1 9/2013

OTHER PUBLICATIONS

PCT International Search Report and Written Opinion for Application No. PCT/US2015/039964 dated Dec. 1, 2015 (15 pages).
(Continued)

*Primary Examiner* — John Kreck
(74) *Attorney, Agent, or Firm* — Michael Best & Friedrich LLP

(57) ABSTRACT

A cutter head for a mining machine includes a drum defining a drum axis with a drum plane extending perpendicular to the drum axis. The cutter head includes a plurality of cutting bit assemblies secured to an outer surface of the drum proximate a first end. Each cutting bit assembly includes a block and a bit. The bit includes a tip configured to engage a mine surface. The bit defines a bit axis, and the bit axis defines a first lean angle relative to the drum plane. The plurality of cutting bit assemblies includes a first series having four first bits, a second series having two second bits, a third series having two third bits, and a fourth series having two fourth bits. Each of the first bits includes a first tip and defines a first bit axis oriented at a first lean angle relative to the drum plane. The first lean angle is between about 60 degrees and about 75 degrees.

26 Claims, 5 Drawing Sheets

(56) References Cited

U.S. PATENT DOCUMENTS

| | | | | |
|---|---|---|---|---|
| 5,647,641 | A * | 7/1997 | Sulosky | B28D 1/186 299/106 |
| 5,775,781 | A | 7/1998 | Sawtelle et al. | |
| 5,842,747 | A | 12/1998 | Winchester | |
| 6,315,365 | B1 | 11/2001 | Gerer et al. | |
| 6,547,484 | B2 | 4/2003 | Murphy | |
| 6,626,500 | B1 | 9/2003 | Cribb et al. | |
| 6,779,850 | B1 | 8/2004 | Schibeci et al. | |
| 7,547,074 | B2 | 6/2009 | Beach et al. | |
| 8,628,147 | B2 | 1/2014 | O'Neill | |
| 2006/0255649 | A1 * | 11/2006 | Dawood | E21C 35/18 299/87.1 |
| 2014/0167487 | A1 | 6/2014 | Myers et al. | |

OTHER PUBLICATIONS

Brooker, "Theoretical and Practical Aspects of Cutting and Loading by Shearer Drums", Technical Consultancy Cutting Group, MRDE, NCB, reprinted from Colliery Guardian Coal International, Jan. and Apr. 1979, Part 1 (15 pages).

Tiryaki, Improvement in Drum Design Technology at Beypazari (Cayirhan) Lignite Mine, The University of Queensland, Department of Mechanical Engineering & CRC Mining, available before Jul. 9, 2014 (27 pages).

Tiryaki, "In situ studies on service life and pick consumption characteristics of shearer drums", The Journal of the South African Institute of Mining and Metallurgy, Mar. 2004, pp. 107-122.

* cited by examiner

BIT CONFIGURATION FOR A CUTTER HEAD

BACKGROUND

The present invention relates to mining machines. Specifically, the present invention relates to a configuration of cutting bit assemblies located on a mining machine.

Conventional continuous mining machines include a cutter head including multiple cutting bit assemblies operable to cut into a mining surface. In some embodiments, each cutting bit assembly includes a bit coupled to a holder block, and the holder block is affixed to a rotating drum. In some embodiments, the bit may be received within a sleeve that is in turn secured within the holder block. The cutting bit assemblies are positioned and oriented on the cutter head to increase the performance or efficiency of the continuous mining machine as it cuts material from the mine face.

SUMMARY

In one aspect, a cutter head for a mining machine includes a drum having a first end and a second end and defining a drum axis extending between the first end and the second end. The drum is rotatable about the drum axis, and a drum plane extends perpendicular to the drum axis. The cutter head includes a plurality of cutting bit assemblies secured to an outer surface of the drum proximate the first end of the drum. Each cutting bit assembly includes a block and a bit. The block has a bore, and the bit is positioned at least partially in the bore of the block and includes a tip configured to engage a mine surface. The bit defines a bit axis, and the bit axis defines a first lean angle relative to the drum plane. The plurality of cutting bit assemblies includes a first series having four first bits. Each of the first bits includes a first tip and defines a first bit axis oriented at a first lean angle relative to the drum plane. The first lean angle is between about 60 degrees and about 75 degrees.

In another aspect, a cutter head for a mining machine includes a drum having a first end and a second end and defining a drum axis extending between the first end and the second end. The drum is rotatable about the drum axis with a drum plane extending perpendicular to the drum axis. The cutter head includes a first bit coupled to the drum having a first tip and defining a first bit axis. The first bit axis is oriented at a first lean angle relative to a drum plane. The cutter head includes a second bit coupled to the drum having a second tip and defining a second bit axis. The second bit axis is oriented at a second lean angle relative to the drum plane. The cutter head includes a third bit coupled to the drum having a third tip and defining a third bit axis. The third bit axis is oriented at a third lean angle relative to the drum plane. The cutter head includes a fourth bit coupled to the drum having a fourth tip and defining a fourth bit axis. The fourth bit axis is oriented at a fourth lean angle relative to the drum plane. The cutter head includes a fifth bit coupled to the drum having a fifth tip and defining a fifth bit axis. The fifth bit axis is oriented at the first lean angle relative to the drum plane. The first lean angle is greater than the second lean angle, the second lean angle is greater than the third lean angle, and the third lean angle is greater than the fourth lean angle. As the drum rotates about the drum axis, the bits having a first lean angle engage the mine surface at least twice as frequently as a bit having any of the other lean angles.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

Figure 1:
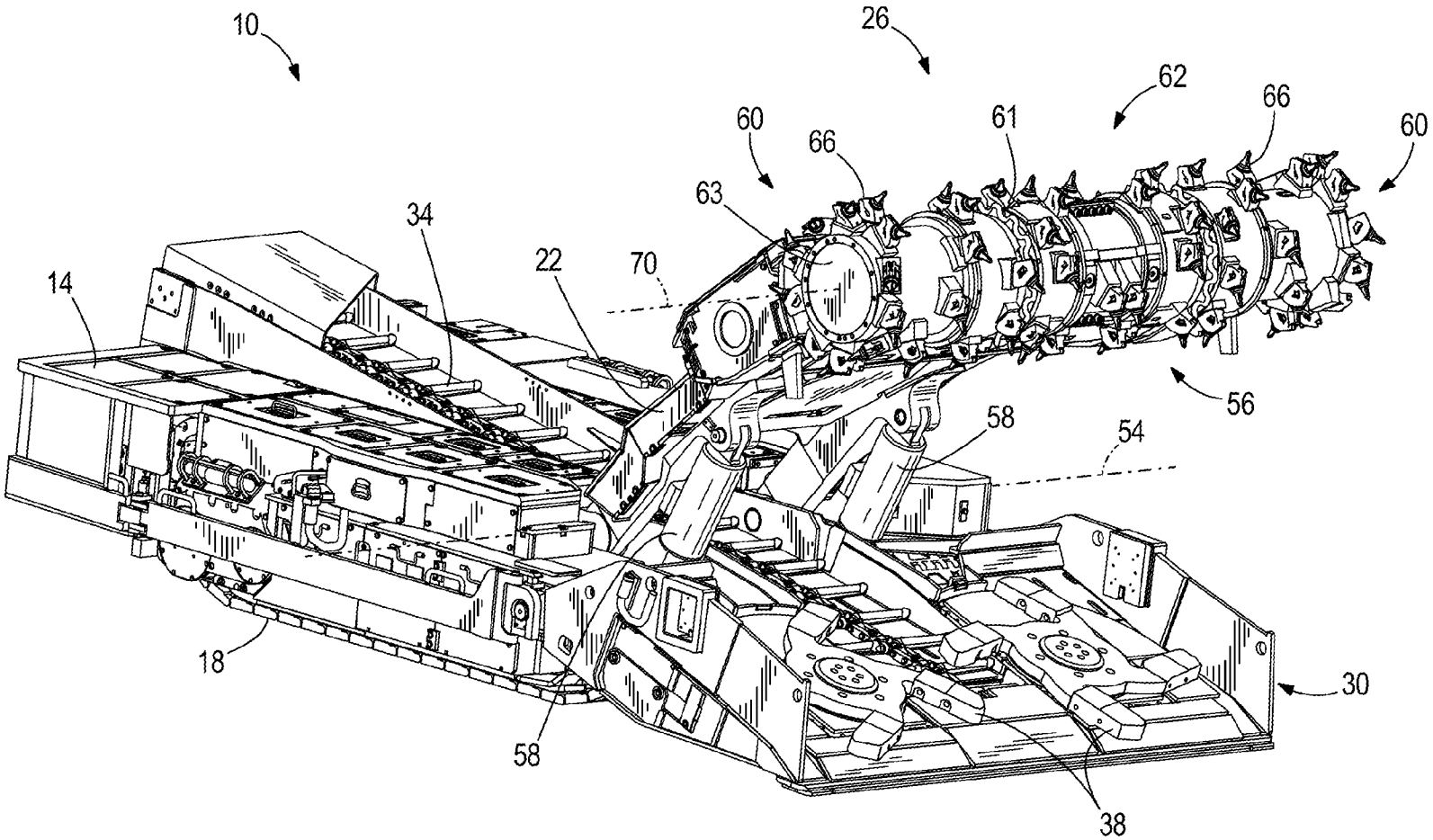
FIG. 1 is a perspective view of a mining machine including a cutter head.

FIG. 1 illustrates a mining machine, such as a continuous miner 10, including a frame 14 that is supported for movement, for example by tracks 18. The continuous miner 10 further includes a boom 22 and a cutter head 26 supported on the boom 22. In the illustrated embodiment, the frame 14 also includes a gathering head 30 and a conveyor 34 extending from a first or front end of the frame 14 toward a second or rear end of the frame 14. After material is cut from a mine face by the cutter head 26, the material may fall to the mine floor. The gathering head 30 includes a pair of rotating arms 38 that engage the cut material below the cutter head 26 and direct the cut material onto the conveyor 34. The conveyor 34 transports the cut material along a longitudinal axis (not shown) of the frame 14, from the gathering head 30 to a second conveyor (not shown) positioned proximate the second or rear end of the frame 14.

The boom 22 includes one end pivotably coupled to the frame 14 and another end supporting the cutter head 26. The boom 22 is pivotable about a pivot axis 54 that is generally transverse to the longitudinal axis of the frame 14. The boom 22 is pivoted by a pair of actuators 58 that are coupled between the frame 14 and the boom 22. In the illustrated embodiment, the actuators 58 are hydraulic jacks or cylinders.

The cutter head 26 includes an elongated drum 62 and cutting bit assemblies 66 secured to an outer surface of the drum 62. In the illustrated embodiment, the drum 62 defines a drum axis 70 that is generally parallel to the pivot axis 54 of the boom 22, and the drum 62 is rotatable about the drum axis 70. In one embodiment, the cutter head 26 includes end portions 60 and an intermediate portion 56 positioned between the end portions 60. A proximal end 61 of the end portions 60 is adjacent the intermediate portion 56, whereas a distal end 63 of the end portions 60 is located opposite (e.g., axially spaced apart from) the proximal end 61. In other embodiments, the cutter head 26 may include fewer or more than three portions.

Figure 2:
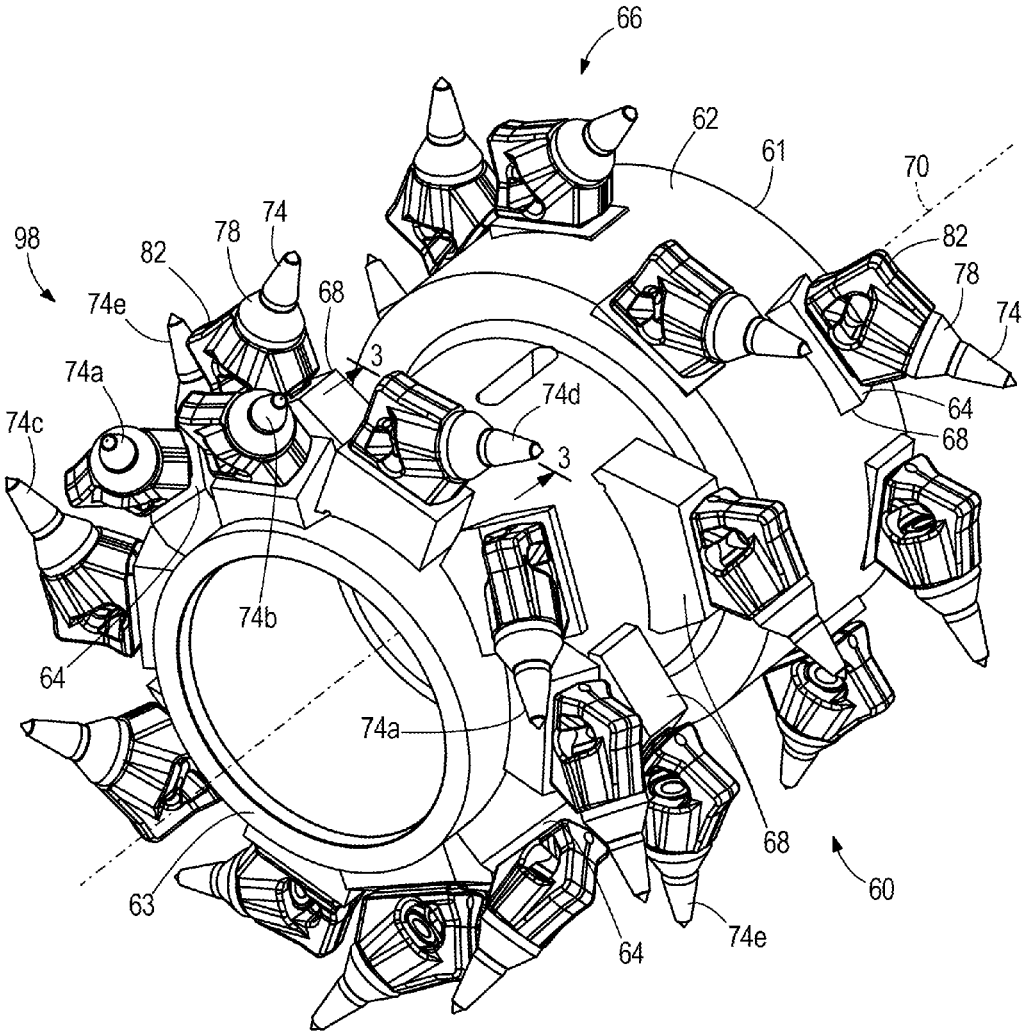
FIG. 2 is a perspective view of a portion of the cutter head of FIG. 1.
Figure 3:
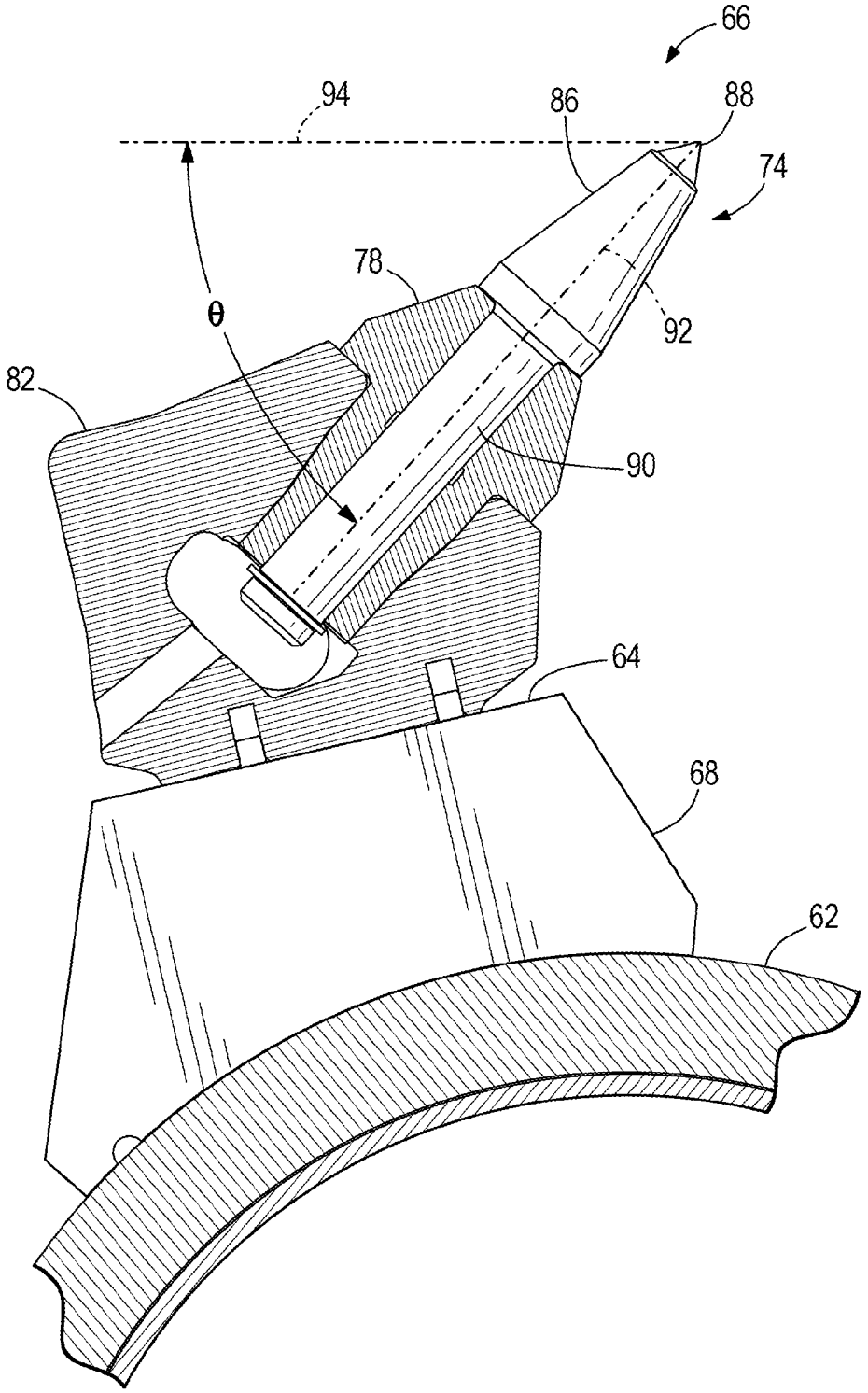
FIG. 3 is a cross sectional view of a portion of the cutter head of FIG. 2 viewed along section 3-3.

FIG. 2 illustrates one of the end portions 60. In the illustrated embodiment, an outer surface of each end portion 60 is stepped such that the proximal end 61 has a larger diameter than the distal end 63. Referring now to FIGS. 2 and 3, the outer surface of the drum 62 includes pedestals 68, and each pedestal 68 defines a surface 64. Each cutting bit assembly 66 includes a pick or bit 74, a sleeve 78, and a holder block 82, and each holder block 82 is affixed to a surface 64 of a corresponding pedestal 68. The sleeve 78 provides a protective interface between the bit 74 and the holder block 82. In some embodiments, the cutting bit assembly 66 may not include the sleeve.

As shown in FIG. 3, in the illustrated embodiment each bit 74 includes a first portion 86 having a tip 88 for engaging a mine face to remove material, and a second portion or shank 90. The shank 90 of each bit 74 is positioned within a bore of the sleeve 78, which is in turn positioned in a bore of the holder block 82. The shank 90 defines a bit axis 92. In one embodiment, the bit axis 92 passes through the tip 88 and the bit axis 92 may be concentrically aligned with the bores of the sleeve 78 and the holder block 82. In the illustrated embodiment, the end of the shank 90 is secured relative to the sleeve 78 by a clip, and the bit 74 is selectively removable from the holder block 82 and may be replaced by a new bit 74.

With reference to FIG. 3, the tip 88 of the illustrated cutting bit assembly 66 is spaced from the drum axis 70 by a radial distance. A first plane 94 (e.g., tangent plane) is tangent to a cutting trajectory at the tip 88 of the bit 86. Stated another way, the first plane 94 intersects the tip 88, and the first plane 94 is perpendicular to a radial line extending from the drum axis 70 to the tip 88. In the illustrated embodiment, the first plane 94 is parallel to the drum axis 70. Each cutting bit assembly 66 includes an attack angle θ defined between the bit axis 92 of the bit shank 90 and the first plane 94.

Figure 4:
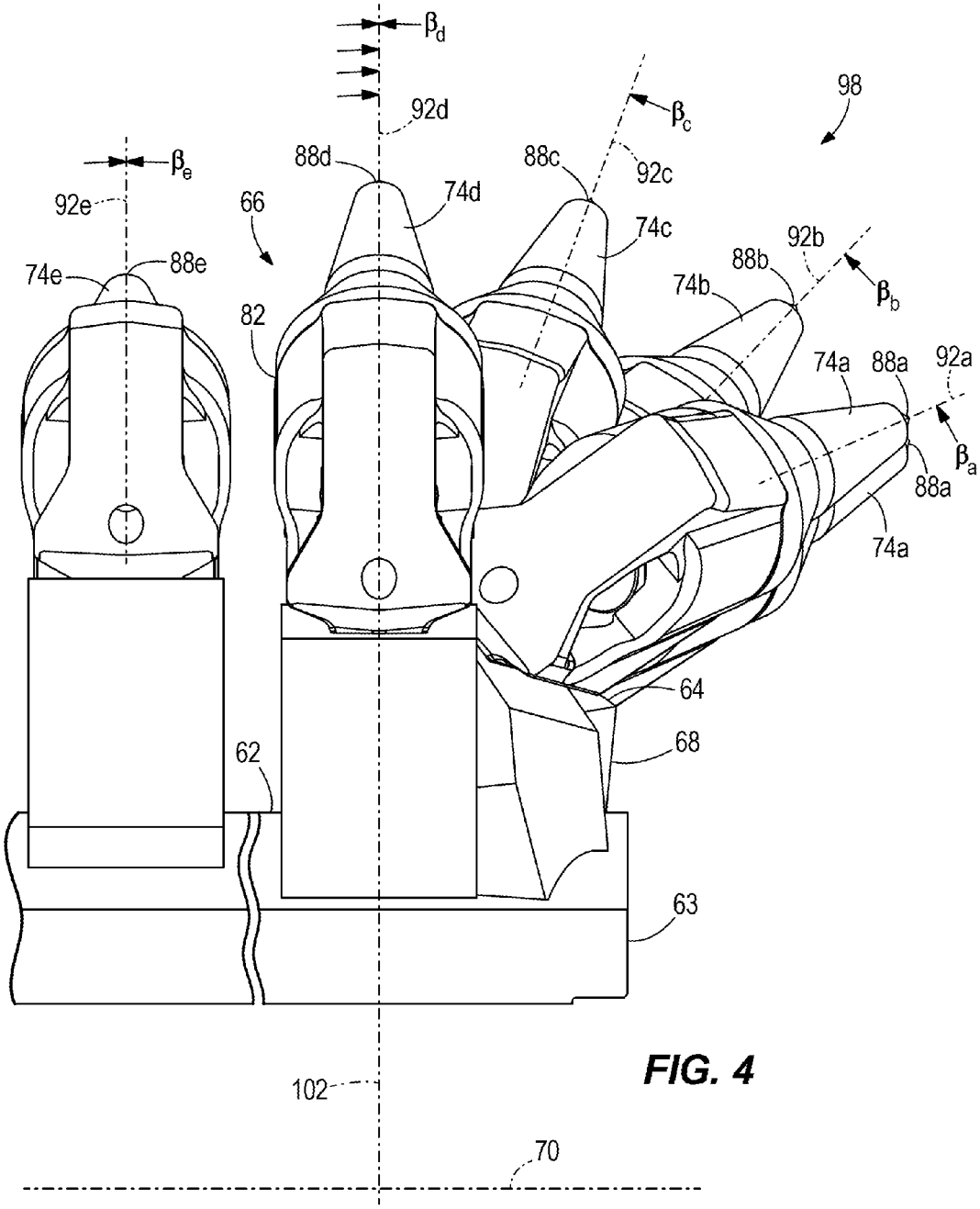
FIG. 4 is a rear view of the cutter head of FIG. 2 including a plurality of cutting bit assemblies.

Referring to FIGS. 2 and 4, the illustrated cutting bit assemblies 66 located adjacent the distal end 63 of the end portion 60 define an end ring bit assembly 98. The end ring bit assembly 98 includes bits 74*a*, 74*b*, 74*c*, 74*d* having corresponding tips 88*a*, 88*b*, 88*c*, 88*d* to engage the mine surface axially beyond the distal end 63 (e.g., positioned to the side of the cutter head 26). The remaining surface of the end portion 60 includes bits 74*e* including tips 88*e* for engaging the mine surface in front of the cutter head 26.

As shown in FIG. 4, a second plane 102 (e.g., drum plane) extends perpendicular to the drum axis 70. In the illustrated embodiment, a lean angle β extends between the second plane 102 and the bit axis 92 of each cutting bit assembly 66. For purposes of this description, a positive lean angle is defined as an angle extending outwardly or away from the distal end 63 of the end portion, and away from the second plane 102. Similarly, a negative lean angle is defined as an angle extending outwardly from the distal end 63 and toward the proximal end 61. In cases where the bit axis 92 is aligned in the second plane 102 (or a plane parallel to the second plane 102), the lean angle is zero degrees. In the illustrated embodiment, some of the cutting bit assemblies 66 include a bit axis 92 oriented at a lean angle of zero degrees. Other cutting bit assemblies include bits 74*a*, 74*b*, 74*c*, 74*d* oriented at various lean angles β. In one embodiment, the surface 64 of a respective pedestal 68 is oriented at a desired lean angle relative to the drum axis 70 such that the cutting bit assembly 66 coupled to the surface 64 has the desired lean angle β.

In some embodiments, at least one cutting bit assembly 66 may be supported at a lean angle relative to the second plane 102. If the lean angle β is non-zero, the bit axis 92 may be projected onto the second plane 102. An angle between the projected bit axis and the first plane 94 defines an effective attack angle. In one embodiment, the effective attack angle θ is between about 45 degrees and about 55 degrees. In one embodiment, the effective attack angle is 50 degrees. In other embodiments, the effective attack angle may be differently configured dependent upon other parameters (e.g., geometry of the bit, type of material to be cut, depth of cut of the cutter head, etc.). In addition, in some embodiments the effective attack angle for all of the cutting bit assemblies 66 (bits 74*a*-74*e*) is the same.

In the illustrated embodiment, the bit 74*a* includes a first lean angle $\beta_a$ that is defined between the second plane 102 and the bit axis 92*a*, the bit 74*b* includes a second lean angle $\beta_b$ that is defined between the second plane 102 and the bit axis 92*b*, the bit 74*c* includes a third lean angle $\beta_c$ that is defined between the second plane 102 and the bit axis 92*c*, and the bit 74*d* includes a fourth lean angle $\beta_d$ that is defined between the second plane 102 and the bit axis 92*d*.

In one embodiment, the first lean angle $\beta_a$ is between about 60 degrees and about 75 degrees. In one embodiment, the second lean angle $\beta_b$ is between about 30 degrees and about 45 degrees. In one embodiment, the third lean angle $\beta_c$ is between about 15 degrees and about 25 degrees. In one embodiment, the fourth lean angle $\beta_d$ is between about 0 degrees and about 10 degrees. In one embodiment, the first lean angle $\beta_a$ is between about 60 degrees and about 65 degrees. In one embodiment, the second lean angle $\beta_b$ is between about 30 degrees and about 35 degrees. In one embodiment, the third lean angle $\beta_c$ is between about 15 degrees and about 20 degrees. In one embodiment, the fourth lean angle $\beta_d$ is between about 0 degrees and about 5 degrees. In addition, a fifth lean angle $\beta_e$ of the bits 74*e* (i.e., the lean angle of the bits 74*e* that are not part of the end ring bit assembly 98) may be between about 0 degrees and 10 degrees. In one embodiment, the first lean angle $\beta_a$ is about 60 degrees. In one embodiment, the second lean angle $\beta_b$ is about 30 degrees. In one embodiment, the third lean angle $\beta_c$ is about 20 degrees. In one embodiment, the fourth lean angle $\beta_d$ is about 0 degrees. In one embodiment, and the fifth lean angle $\beta_e$ is about 0 degrees.

Figure 5:
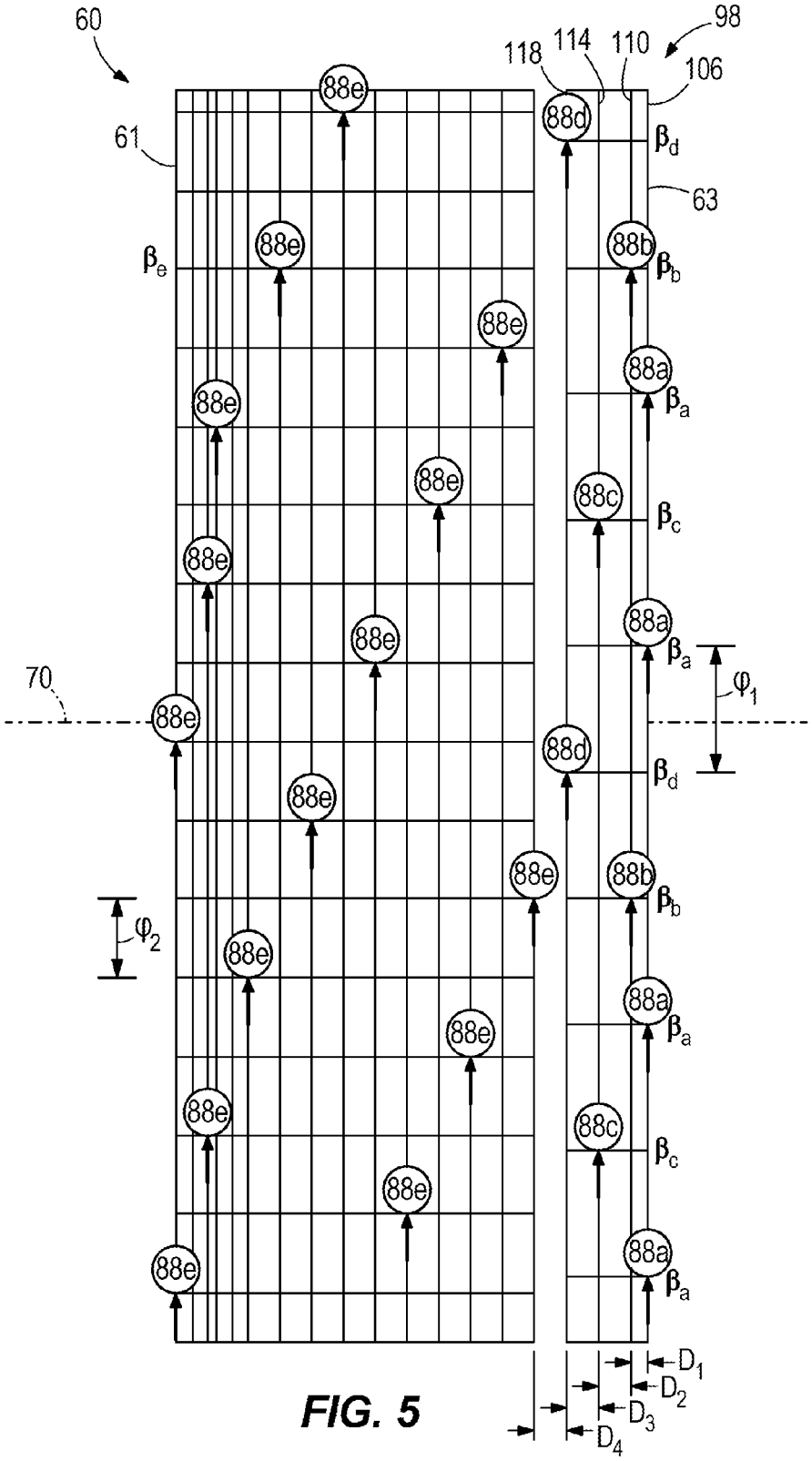
FIG. 5 illustrates a projection of the cutter head of FIG. 2 illustrating a configuration of the plurality of cutting bit assemblies.

FIG. 5 illustrates the tip 88 of the bit 74 for each cutting assembly 66 of the drum end portion 60 projected onto a flat or planar representation. Each tip 88 is represented as a circle. Each vertical line in the projection represents a cutting line aligned with at least one tip 88 and extending circumferentially around the surface of the end portion 60. Each horizontal line is aligned with at least one tip 88 and extends axially along the end portion 60 (although the circles are shown above the horizontal lines, it is understood that the horizontal lines coincide with the tips 88).

The end portion 60 includes a main portion positioned adjacent the proximal end 61 and the end ring bit assembly 98 positioned adjacent the distal end 63. The end ring bit assembly 98 includes four bits 74*a*, each of which includes a tip 88*a*. The tips 88*a* define a first cutting line 106. In addition, two bits 74*b* each include tips 88*b* that define a second cutting line 110. Two bits 74*c* each include tips 88*c* that define a third cutting line 114, and two bits 74*d* each include tips 88*d* that define a fourth cutting line 118. In the illustrated embodiment, each of the bits 74*e* in the main portion includes a tip 88*e* defining an individual cutting line; that is, none of the bits 74*e* are aligned along a common cutting line.

As the cutter head 26 rotates about the drum axis 70 (FIG. 2), the cutting lines 106, 110, 114, 118 each define an individual cutting plane. In the illustrated embodiment, the first cutting line 106 is axially separated from the second cutting line 110 by a first distance $D_1$, the second cutting line 110 is axially separated from the third cutting line 114 by a second distance $D_2$, the third cutting line 114 is axially separated from the fourth cutting line 118 by a third distance $D_3$, and the fourth cutting line 118 is axially separated from the cutting bit 74*e* that is adjacent the end ring bit assembly 98 by a fourth distance $D_4$. In one embodiment, the first distance $D_1$ is between about 27 millimeters and 47 millimeters, the second distance $D_2$ is between about 60 millimeters and 80 millimeters, the third distance $D_3$ is between about 67 millimeters and 87 millimeters, and the fourth distance $D_4$ is between about 62 millimeters and 82 millimeters. In one embodiment, the first distance $D_1$ is about 37 millimeters, the second distance $D_2$ is about 70 millimeters, the third distance $D_3$ is about 77 millimeters, and the fourth distance $D_4$ is about 72 millimeters.

During a full rotation of the cutter head 26, the end ring bit assembly 98 engages the mine surface and completes a cutting sequence. In the illustrated embodiment, the cutting sequence includes engaging the mine surface with the tips of the end ring bits in the following order: bit 74*d*, bit 74*b*, bit 74*a*, bit 74*c*, bit 74*a*, bit 74*d*, bit 74*b*, bit 74*a*, bit 74*c*, and bit 74*a*. Consequently, the end ring bit assembly 98 includes ten bits 74 that each engages the mine surface. The outermost bits 74*a* engage the mine surface twice as frequently compared to each of the bits 74*b*, 74*c*, 74*d* (four times per rotation compared to two times per rotation) and four times as frequently compared to each bit 74*e* on the main portion (four time per rotation compared to once per rotation for each bit 74*e*).

In the illustrated embodiment, the tips 88*a*, 88*b*, 88*c*, 88*d*, of the bits 74*a*, 74*b*, 74*c*, 74*d* are angularly spaced apart from each other by a circumferential angle $\phi_1$ about the drum axis 70. Each tip 88*a*, 88*b*, 88*c*, 88*d* is spaced apart from the nearest adjacent tip by an angle, and the angle is equal for each of the tips 88*a*, 88*b*, 88*c*, 88*d*. Stated another way, the tips 88*a*, 88*b*, 88*c*, 88*d* are equally spaced around the drum 62. In one embodiment, the circumferential angle $\phi_1$ between each tip 88*a*, 88*b*, 88*c*, 88*d* of the end ring bit assembly 98 is about 36 degrees. In one embodiment, the circumferential angle $\phi_2$ between adjacent tips 88*e* of the main portion is about 22.5 degrees. In other embodiments, the circumferential angle between adjacent bits may be more or less, and/or the circumferential angle between the bits may be non-uniform such that the space between some bits is greater than the space between others.

The improved configuration of the end ring bit assembly 98 (the combination of cutting bits 74 with the attack angle $\theta$, the lean angles $\beta_a$-$\beta_d$, the circumferential angle $\phi$, and/or the axial distances $D_1$-$D_4$) causes the reaction forces applied to the bits 74*a*, 74*b*, 74*c*, 74*d* to be more evenly distributed such that the tips 88*a*, 88*b*, 88*c*, 88*d* reducing the risk of premature failure of a bit or a group of bits due to overloading. In addition, the configuration of the end ring bit assembly 98 inhibits direct contact between the mine surface and the elongated drum 62, the pedestals 68, the holder blocks 82, and/or the sleeves 78, thereby preventing sparks. Furthermore, in some embodiments, all of the bits 74*a*-74*e* on the drum 62 include the same effective attack angle, providing more even distribution of cutting forces over the bits 74*a*-74*e* and providing a rotationally balanced cutter head 26 to reduce cutting vibrations during a mining operation.

Although the configuration of the cutting bit assemblies has been described above with respect to an exemplary mining machine (e.g., a continuous mining machine), it is understood that the configuration of cutting bit assemblies could be incorporated onto various types of cutter heads and various types of mining machines.

Thus, the invention provides, among other things, a bit configuration for a cutter head. Although the invention has been described in detail with reference to certain preferred embodiments, variations and modifications exist within the scope and spirit of one or more independent aspects of the invention as described.

The invention claimed is:

1. A cutter head for a mining machine, the cutter head comprising:

a drum including a first end and a second end and defining a drum axis extending between the first end and the second end, the drum rotatable about the drum axis, a drum plane extending perpendicular to the drum axis; and a plurality of cutting bit assemblies secured to an outer surface of the drum proximate the first end of the drum, each cutting bit assembly including a block and a bit, the block having a bore, the bit positioned at least partially in the bore of the block and including a tip configured to engage a mine surface, the bit defining a bit axis, the bit axis defining a first lean angle relative to the drum plane;

wherein the plurality of cutting bit assemblies includes a first series having four first bits, each of the first bits including a first tip and defining a first bit axis oriented at a first lean angle relative to the drum plane, the first lean angle between about 65 degrees and about 75 degrees.

2. The cutter head of claim 1, wherein the plurality of cutting bit assemblies further includes a second series having two second bits secured to the outer surface of the drum proximate the first end, each of the second bits including a second tip and defining a second bit axis oriented at a second lean angle relative to the drum plane, wherein the second lean angle is between about 30 degrees and about 45 degrees.

3. The cutter head of claim 2, wherein the plurality of cutting bit assemblies further includes a third series having two third bits secured to the outer surface of the drum proximate the first end, each of the third bits including a third tip and defining a third bit axis oriented at a third lean angle relative to the drum plane, wherein the third lean angle is between about 15 degrees and about 20 degrees.

4. The cutter head of claim 3, wherein the plurality of cutting bit assemblies further includes a fourth series having two fourth bits secured to the outer surface of the drum proximate the first end, each of the fourth bits including a fourth tip and defining a fourth bit axis oriented at a fourth lean angle relative to the drum plane, wherein the fourth lean angle is between about 0 degrees and about 10 degrees.

5. The cutter head of claim 4, wherein the first tips of the first bits are located at an outermost position relative to the first end of the drum, the second tips of the second bits are located between the first tips and the third tips along the drum axis, and the third tips are located between the second tips and the fourth tips along the drum axis.

6. The cutter head of claim 5, wherein the plurality of cutting bit assemblies further includes a fifth series having a plurality of bits secured to the outer surface of the drum, each of the fifth bits defining a fifth bit axis oriented at the fourth lean angle relative to the drum plane, each of the fifth bits located between the fourth series of bits and the second end of the drum.

7. The cutter head of claim 6, wherein a first axial distance between the first tips and the second tips is between about 27 millimeters and about 47 millimeters;

a second axial distance between the second and the third series of bits, the second axial distance is between about 60 millimeters and about 80 millimeters;

a third axial distance between the third and the fourth series of bits, the third axial distance is between about 67 millimeters and about 87 millimeters.

8. The cutter head of claim 1, wherein each first tip defines a radial line extending between the first tip and the drum axis, and each first tip defines a tangent plane oriented perpendicular to the radial line, wherein projecting the first bit axis of each first bit onto a plane perpendicular to the drum axis defines a projected first bit axis, wherein a first effective attack angle extends between the projected first bit axis and the tangent plane defined by the associated first tip, wherein the effective attack angle is between about 45 degrees and about 55 degrees.

9. The cutter head of claim 4, wherein the bits define a plurality of radial lines extending between the drum axis and the tip of a respective bit, wherein the bits define a plurality of tangent planes, each tangent plane oriented perpendicular to one of the radial lines, wherein projecting the first bit axis of each first bit onto the drum plane defines a projected first bit axis, a first effective attack angle extending between the projected first bit axis and the tangent plane defined by the associated first tip, wherein projecting the second bit axis of each second bit onto the drum plane defines a projected second bit axis, a second effective attack angle extending between the projected second bit axis and the tangent plane defined by the associated second tip, wherein projecting the third bit axis of each third bit onto the drum plane defines a projected third bit axis, a third effective attack angle extending between the projected third bit axis and the tangent plane defined by the associated third tip, wherein projecting the fourth bit axis of each fourth bit onto the drum plane defines a projected fourth bit axis, a fourth effective attack angle extending between the projected fourth bit axis and the tangent plane defined by the associated fourth tip, wherein the effective attack angle is between about 45 degrees and about 55 degrees.

10. The cutter head of claim 1, wherein the drum includes a first end portion defining the first end, a second end portion defining the second end, and an intermediate portion positioned between the first end portion and the second end portion.

11. A cutter head for a continuous mining machine, the cutter head comprising:

a drum including a first end and a second end and defining a drum axis extending between the first end and the second end, the drum rotatable about the drum axis and supported for advancing into a mine face in a direction substantially perpendicular to the drum axis, a drum plane extending perpendicular to the drum axis;

a first bit coupled to the drum including a first tip and defining a first bit axis, the first bit axis oriented at a first lean angle relative to the drum plane;

a second bit coupled to the drum including a second tip and defining a second bit axis, the second bit axis oriented at a second lean angle relative to the drum plane;

a third bit coupled to the drum including a third tip and defining a third bit axis, the third bit axis oriented at a third lean angle relative to the drum plane;

a fourth bit coupled to the drum including a fourth tip and defining a fourth bit axis, the fourth bit axis oriented at a fourth lean angle relative to the drum plane; and a fifth bit coupled to the drum including a fifth tip and defining a fifth bit axis, the fifth bit axis oriented at the first lean angle relative to the drum plane;

wherein the first lean angle is greater than the second lean angle, the second lean angle is greater than the third lean angle, and the third lean angle is greater than the fourth lean angle; and wherein as the drum rotates about the drum axis, the bits having a first lean angle engage the mine surface at least twice as frequently as a bit having any of the other lean angles.

12. The cutter head of claim 11, wherein as the drum rotates about the drum axis, the fourth bit, the second bit, the first bit, the third bit, and the fifth bit sequentially engage a mine surface.

13. The cutter head of claim 11, wherein the first lean angle is between about 60 degrees and about 75 degrees, the second lean angle is between about 30 degrees and about 45 degrees, the third lean angle is between about 15 degrees and about 20 degrees, and the fourth lean angle is between about 0 degrees and about 10 degrees.

14. The cutter head of claim 11, wherein the first tip and the fifth tip are located from the second tip at a first axial distance between about 27 millimeters and about 47 millimeters, the second tip is located from the third tip at a second axial distance between about 60 millimeters and about 80 millimeters, and the third tip is located from the fourth tip at a third axial distance between about 67 millimeters and about 87 millimeters.

15. The cutter head of claim 11, wherein the first tips of the first bits and the fifth tips of the fifth bits are located at an outermost position relative to the first end of the drum, the second tips of the second bits are located between the first tips and the third tips along the drum axis, and the third tips are located between the second tips and the fourth tips along the drum axis.

16. The cutter head of claim 11, wherein each tip defines a radial line extending between the tip of the bit and the drum axis, and each tip defines a tangent plane oriented perpendicular to the radial line, wherein projecting the first bit axis of each first bit onto a plane perpendicular to the drum axis defines a projected first bit axis, wherein a first effective attack angle extends between the projected first bit axis and the tangent plane defined by the associated first tip, wherein the effective attack angle is between about 45 degrees and about 55 degrees.

17. The cutter head of claim 16, wherein the second, third, fourth, and fifth bits include the effective attack angle defined by the respective projected bit axis of the bits and the respective tangent plane.

18. The cutter head of claim 11, wherein the first and the fifth tips are associated with a first series of tips, the first series of tips engaging the mine surface four times during one revolution of the drum, the second, third, and fourth tips are associated with a respective series of tips, the respective series of tips engaging the mine surface twice during one revolution of the drum.

19. The cutter head of claim 11, wherein each of the first tip, the second tip, the third tip, the fourth tip, and the fifth tip are equally spaced apart from the nearest adjacent tip.

20. The cutter head of claim 19, wherein the angular spacing between each of the first tip, the second tip, the third tip, the fourth tip, and the fifth tip is about 36 degrees.

21. The cutter head of claim 11, wherein the drum includes a first end portion defining the first end, a second end portion defining the second end, and an intermediate portion positioned between the first end portion and the second end portion.

22. The cutter head of claim 1, wherein the plurality of cutting bit assemblies are also secured to the outer surface of the drum proximate the second end of the drum.

23. The cutter head of claim 2, wherein the first tips of the first bits and the second tips of the second bits are positioned beyond the first end of the drum in a direction opposite the second end of the drum along the drum axis.

24. The cutter head of claim 11, wherein the first, second, third, fourth, and fifth bits are coupled to the drum proximate the first end, the cutter head further comprising another first, second, third, fourth, and fifth bits coupled to the drum proximate the second end.

25. The cutter head of claim 15, wherein the first tips of the first bits, the second tips of the second bits, and the fifth tips of the fifth bits are positioned beyond the first end of the drum in a direction opposite the second end of the drum along the drum axis.

26. A cutter head for a mining machine, the cutter head comprising:

a drum including a first end and a second end and defining a drum axis extending between the first end and the second end, the drum rotatable about the drum axis, a drum plane extending perpendicular to the drum axis;

a first plurality of cutting bit assemblies secured to an outer surface of the drum proximate the first end of the drum, the first plurality of cutting bit assemblies including a first bit having a first tip and defining a first bit axis, the first bit axis oriented at a first lean angle relative to the drum plane;

a second bit having a second tip and defining a second bit axis, the second bit axis oriented at a second lean angle relative to the drum plane;

a third bit having a third tip and defining a third bit axis, the third bit axis oriented at a third lean angle relative to the drum plane;

a fourth bit having a fourth tip and defining a fourth bit axis, the fourth bit axis oriented at a fourth lean angle relative to the drum plane; and a fifth bit having a fifth tip and defining a fifth bit axis, the fifth bit axis oriented at the first lean angle relative to the drum plane;

a second plurality of cutting bit assemblies secured to the outer surface of the drum proximate the second end of the drum, the second plurality of cutting bit assemblies including a sixth bit having a sixth tip and defining a sixth bit axis, the sixth bit axis oriented at a sixth lean angle relative to the drum plane;

a seventh bit having a seventh tip and defining a seventh bit axis, the seventh bit axis oriented at a seventh lean angle relative to the drum plane;

an eighth bit having an eighth tip and defining an eighth bit axis, the eighth bit axis oriented at an eighth lean angle relative to the drum plane;

a ninth bit having a ninth tip and defining a ninth bit axis, the ninth bit axis oriented at a ninth lean angle relative to the drum plane; and a tenth bit having a tenth tip and defining a tenth bit axis, the tenth bit axis oriented at the sixth lean angle relative to the drum plane;

wherein the first and sixth lean angles are between about 65 degrees and about 75 degrees relative to the drum plane, the first and the sixth lean angles are greater than the second and seventh lean angles, the second and seventh lean angles are greater than the third and eighth lean angles, and the third and eighth lean angles are greater than the fourth and ninth lean angles; and wherein as the drum rotates about the drum axis, the bits having the first and sixth lean angles engage the mine surface at least twice as frequently as a bit having any of the other lean angles.

* * * * *